US011004594B2

(12) United States Patent
Yamaguchi et al.

(10) Patent No.: US 11,004,594 B2
(45) Date of Patent: May 11, 2021

(54) SURGE VOLTAGE REDUCTION MEMBER

(71) Applicant: YAZAKI CORPORATION, Tokyo (JP)

(72) Inventors: Yasuhiro Yamaguchi, Shizuoka (JP); Hayato Iizuka, Shizuoka (JP); Hiroaki Imai, Shizuoka (JP); Naoki Fujimoto, Shizuoka (JP); Hiroshi Aihara, Aichi-ken (JP)

(73) Assignee: YAZAKI CORPORATION, Tokyo (JP)

( * ) Notice: Subject to any disclaimer, the term of this patent is extended or adjusted under 35 U.S.C. 154(b) by 493 days.

(21) Appl. No.: 16/029,540

(22) Filed: Jul. 6, 2018

(65) Prior Publication Data

US 2019/0013146 A1 Jan. 10, 2019

(30) Foreign Application Priority Data

Jul. 7, 2017 (JP) ..... JP2017-133378

(51) Int. Cl.

| | |
|---|---|
| ***H01F 17/04*** | (2006.01) |
| ***H01F 27/34*** | (2006.01) |
| ***H01F 27/24*** | (2006.01) |
| ***H01F 27/28*** | (2006.01) |

(52) U.S. Cl.

CPC ..... *H01F 27/343* (2013.01); *H01F 27/24* (2013.01); *H01F 27/2823* (2013.01)

(58) Field of Classification Search

CPC ..... H01F 27/343; H01F 17/062; H01F 2017/065; H01F 27/2895; H01F 27/24

USPC ..... 336/221

See application file for complete search history.

(56) References Cited

U.S. PATENT DOCUMENTS

| | | | | |
|---|---|---|---|---|
| 7,397,322 | B2 * | 7/2008 | Hamada | H04B 3/28 333/12 |
| 9,019,061 | B2 * | 4/2015 | Chandrasekaran | H01F 41/02 336/212 |
| 9,815,421 | B2 * | 11/2017 | Yamaguchi | B60R 16/0207 |
| 10,355,418 | B2 * | 7/2019 | Iizuka | H01F 17/062 |
| 10,395,818 | B2 * | 8/2019 | Iizuka | H01F 17/04 |
| 10,431,366 | B2 * | 10/2019 | Iizuka | H01F 17/062 |
| 10,707,628 | B2 * | 7/2020 | Iizuka | H01F 17/062 |

(Continued)

FOREIGN PATENT DOCUMENTS

| | | |
|---|---|---|
| JP | 1-189881 A | 7/1989 |
| JP | 1-236711 A | 9/1989 |

(Continued)

*Primary Examiner* — Alexander Talpalatski
*Assistant Examiner* — Joselito S. Baisa
(74) *Attorney, Agent, or Firm* — Kenealy Vaidya LLP

(57) ABSTRACT

A surge voltage reduction member includes a tubular magnetic body having a through-hole and at least one coil wire. The coil wire is inserted through the through-hole and has a winding portion which is winded around a portion of the magnetic body. The coil wire is formed by connecting a bent coil element wire and a straight coil element wire. Where the coil wire has two or more bent coil element wires, the winding portion is formed by connecting the through-hole passing portion of one of adjacent bent coil element wires to the outside passing portion of the other of the adjacent bent coil element wires and connecting the outside passing portion of the one of the adjacent bent coil element wires to the straight coil element wire.

3 Claims, 7 Drawing Sheets

(56) References Cited

U.S. PATENT DOCUMENTS

| | | | | |
|---|---|---|---|---|
| 2012/0097447 | A1 | 4/2012 | Muraki et al. | |
| 2014/0345937 | A1* | 11/2014 | Wu | H01F 17/06 174/84 R |
| 2016/0336846 | A1* | 11/2016 | Walczak | H02M 7/42 |
| 2017/0174152 | A1* | 6/2017 | Yamaguchi | H01B 7/0045 |

FOREIGN PATENT DOCUMENTS

| | | | |
|---|---|---|---|
| JP | 2-69909 | A | 3/1990 |
| JP | 8-285897 | A | 11/1996 |
| JP | 2004-87854 | A | 3/2004 |
| JP | 2012-90433 | A | 5/2012 |
| JP | 2012-99739 | A | 5/2012 |
| JP | 2012-174661 | A | 9/2012 |

* cited by examiner

SURGE VOLTAGE REDUCTION MEMBER

CROSS REFERENCE TO RELATED APPLICATIONS

This application is based on Japanese Patent Application (No. 2017-133378) filed on Jul. 7, 2017, the contents of which are incorporated herein by reference.

BACKGROUND OF THE INVENTION

1. Field of the Invention

The present invention relates to a surge voltage reduction member for reducing a surge voltage.

2. Description of the Related Art

Among conventional techniques relating to a surge voltage reduction member for reducing a surge voltage is a technique disclosed in JP-A-2012-174661.

A connector device 3 shown in FIG. 6 of JP-A-2012-174661 is a connector device that is provided in an electric vehicle (not shown). The connector device 3 is equipped with two toroidal cores 17a. Each toroidal core 17a is made of a magnetic material and shaped like a circular ring. Power supply AC lines 11a and 12a that extend from a cylindrical portion 32 of the connector device 3 are wound on the different toroidal cores 17a and are connected to a charger (not shown) that is installed in the electric vehicle. A ground line 14 that extends from the cylindrical portion 32 is inserted through the two toroidal cores 17a.

Incidentally, in the conventional technique, the power supply AC lines 11a and 12a which are wound on the respective toroidal cores 17a are to be routed in an electric vehicle, a hybrid vehicle, or the like and hence are relatively long. Where thus the power supply AC lines 11a and 12a are long, work of winding them on the respective toroidal cores 17a is cumbersome. This means a problem that the efficiency of the work of winding the power supply AC lines 11 a and 12a on the respective toroidal cores 17a is low.

Furthermore, in the conventional technique, inside each toroidal core 17a, a large gap is formed between the power supply AC line 11 a or 12a and the inner circumferential surface of the toroidal core 17a. Thus, the ratio of occupation of the power supply AC line 11 a or 12a inside each toroidal core 17a is small, which means a problem that it is difficult to reduce a surge voltage efficiently.

A still further problem of the conventional technique is that winding the power supply AC line 11a and 12a on the respective toroidal cores 17a increases the size of a connector device product.

SUMMARY OF THE INVENTION

The present invention has been made in view of the above circumstances, and an object of the invention is therefore to provide a surge voltage reduction member capable of reducing a surge voltage efficiently, making the efficiency of manufacturing work high, and producing a surge voltage reduction member product that is low in height.

The above-described object of the present invention is achieved by the following configuration.

(1) A surge voltage reduction member including:

a tubular magnetic body having longer portions and shorter portions and a through-hole that is defined by an inner circumferential surface of the magnetic body; and at least one coil wire which is inserted through the through-hole and has a winding portion which is winded around a portion of the magnetic body, wherein the coil wire is formed by connecting a bent coil element wire which is bent so as to have a U shape and a straight coil element wire which has an approximately straight shape;

wherein the coil wire has (N−1) bent coil element wires and one straight coil element wire where N is the number of times in which the bent coil element wire and the straight coil element wire are inserted through the through-hole;

wherein each of the bent coil element wire and the straight coil element wire is formed from a flat-plate-shaped member having a rectangular cross section taken perpendicularly to its axial direction and the bent coil element wire and the straight coil element wire are approximately identical in thickness;

wherein the width of the through-hole in the shorter-axis direction of the magnetic body is approximately equal to the thickness of the bent coil element wire or wires and the straight coil element wire;

wherein the bent coil element wire has a through-hole passing portion that is inserted through the through-hole and an outside passing portion that passes the magnetic body outside when the through-hole passing portion is inserted through the through-hole;

wherein where the coil wire has only one bent coil element wire, the winding portion is formed by connecting the outside passing portion of the bent coil element wire and the straight coil element wire after the through-hole passing portion of the bent coil element wire and the straight coil element wire are inserted through the through-hole; and wherein where the coil wire has two or more bent coil element wires, the winding portion is formed by connecting the through-hole passing portion of one of adjacent bent coil element wires to the outside passing portion of the other of the adjacent bent coil element wires and connecting the outside passing portion of the one of the adjacent bent coil element wires to the straight coil element wire after the through-hole passing portions of the bent coil element wires and the straight coil element wire are inserted through the through-hole.

In this surge voltage reduction member, the winding portion is formed by connecting the through-hole passing portion of the bent coil element wire and the straight coil element wire after the through-hole passing portion of the bent coil element wire and the straight coil element wire are inserted through the through-hole or by connecting the through-hole passing portion of one of adjacent bent coil element wires to the outside passing portion of the other of the adjacent bent coil element wires and connecting the outside passing portion of the one of the adjacent bent coil element wires to the straight coil element wire after the outside passing portions of the bent coil element wires and the straight coil element wire are inserted through the through-hole. Thus, unlike in the conventional technique, work of winding the coil wire on the magnetic body is not necessary.

In the winding method as employed in the conventional technique, the working efficiency lowers as the number of turns (i.e., the number of times each coil wire passes through the through-hole of the magnetic body). In contrast, according to this surge voltage reduction member, since the winding portion is formed by merely connecting the element wires of the coil wire, increase in the number of turns does not affect the working efficiency of manufacture of a surge voltage reduction member product.

In this surge voltage reduction member, each bent coil element wire and the straight coil element wire are formed from a flat-plate-shaped member having a rectangular cross section taken perpendicularly to its axial direction and are approximately identical in thickness. And the width of the through-hole in the shorter-axis direction of the magnetic body is approximately equal to the thickness of the bent coil element wire or wires and the straight coil element wire. As a result, the ratio of occupation of the coil wire inside the inner circumferential surface of the magnetic body can be increased, whereby the height of a surge voltage reduction member product can be lowered.

(2) The surge voltage reduction member according to the configuration (1), wherein where the coil wire has only one bent coil element wire, a portion where the outside passing portion of the bent coil element wire and the straight coil element wire are connected to each other is provided with an insulating member; and wherein where the coil wire has two or more bent coil element wires, a portion where the through-hole passing portion of the one of the adjacent bent coil element wires and the outside passing portion of the other of the adjacent bent coil element wires are connected to each other and a portion where the outside passing portion of the one of the adjacent bent coil element wires and the straight coil element wire are connected to each other are provided with insulating members respectively.

According to this surge voltage reduction member, since the connection portions of the element wires of the coil wire are provided with the respective insulating members, insulation can be attained reliably in the connection portions.

(3) The surge voltage reduction member according to the configuration (1) or (2), further including a protective member which covers the magnetic body.

According to this surge voltage reduction member, since the magnetic body is covered with the protective member, the impact resistance of a surge voltage reduction member product can be increased.

The invention provides advantages that the efficiency of manufacturing work can be made high and a surge voltage reduction member product can be made low in height while a surge voltage is lowered efficiently.

BRIEF DESCRIPTION OF THE DRAWINGS

FIG. 7A is a perspective view showing a state before insertion of bent coil element wires and straight coil element wires through a through-hole of a magnetic body and FIG. 7B is a perspective view showing a state after insertion of the bent coil element wires through the through-hole of the magnetic body.

DETAILED DESCRIPTION OF THE EXEMPLARY EMBODIMENTS

Surge voltage reduction members according to first and second embodiments of the present invention will be hereinafter described with reference to FIGS. 1 to 7B, respectively.

Embodiment 1

Figure 1:
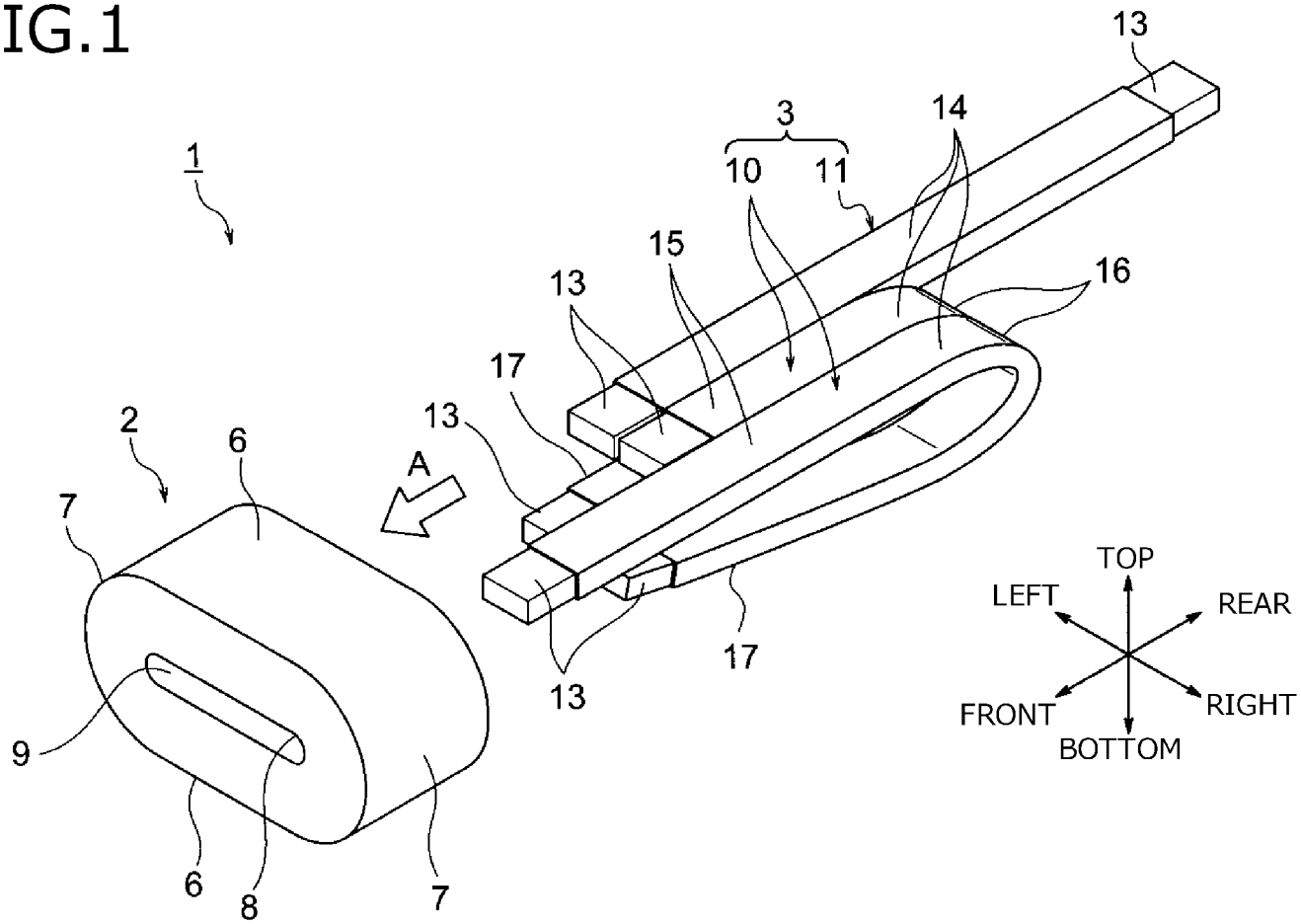
FIG. 1 is an exploded perspective view of a surge voltage reduction member according to a first embodiment of the present invention.
Figure 2:
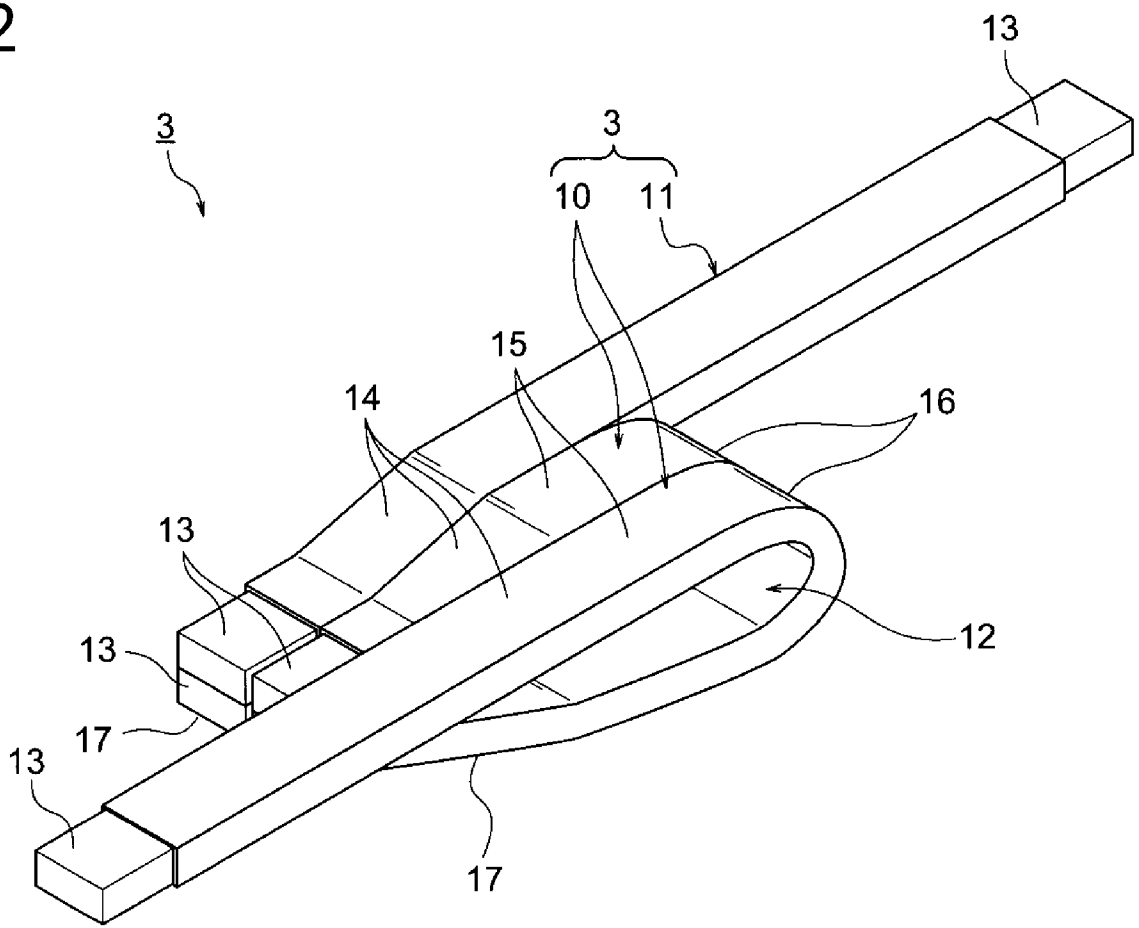
FIG. 2 is a perspective view of a coil wire.
Figure 3A:
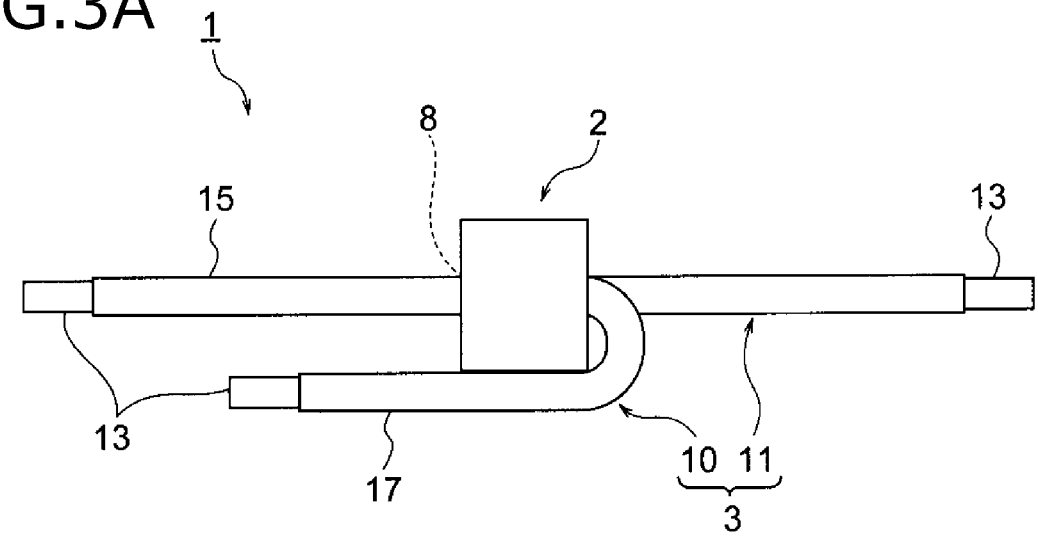
FIGS. 3A and 3B are a side view and a front view of the surge voltage reduction member of the first embodiment, respectively, and illustrate a first part of its manufacturing process.
Figure 3B:
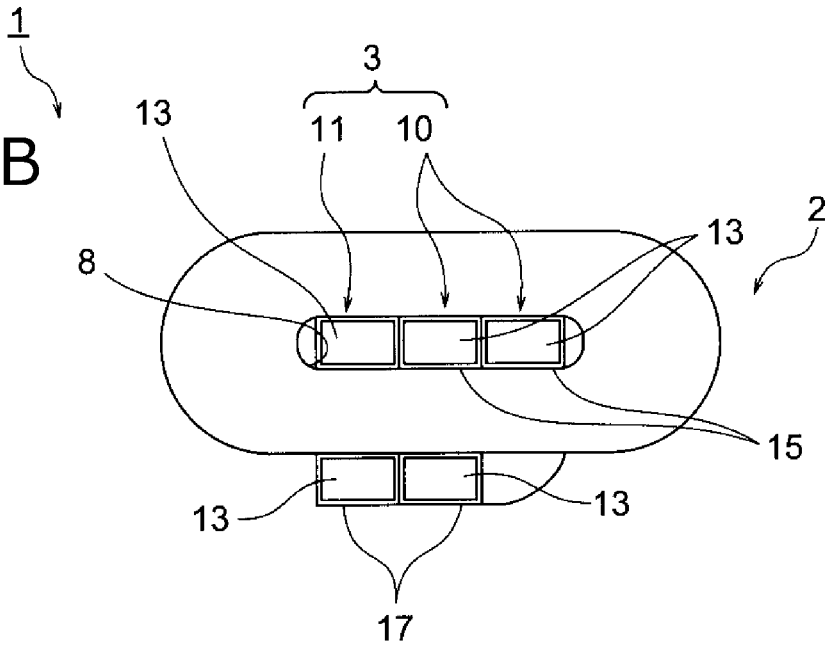
Figure 4A:
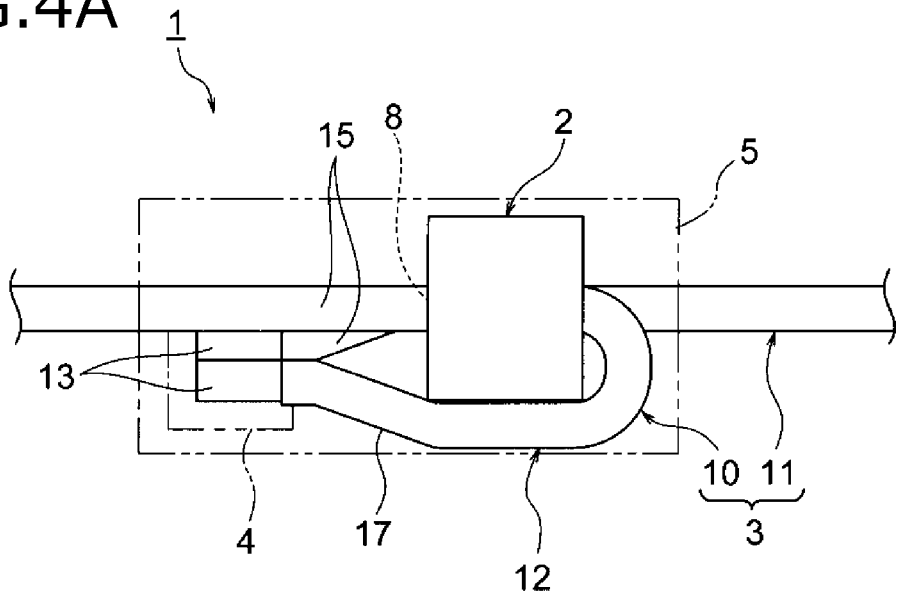
FIGS. 4A and 4B are a side view and a front view of the surge voltage reduction member according to the first embodiment, respectively, and illustrate a second part of its manufacturing process.
Figure 4B:
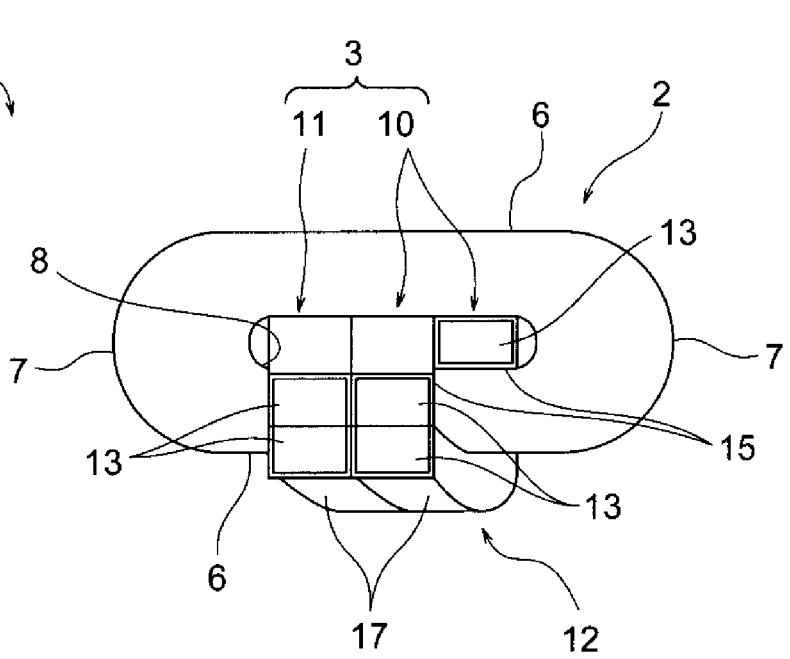

FIG. 1 is an exploded perspective view of the surge voltage reduction member according to the first embodiment of the invention. FIG. 2 is a perspective view of a coil wire. FIGS. 3A and 3B are a side view and a front view of the surge voltage reduction member, respectively, and illustrate a first part of its manufacturing process. FIGS. 4A and 4B are a side view and a front view of the surge voltage reduction member, respectively, and illustrate a second part of its manufacturing process. The arrows shown in FIG. 1 indicate the top-bottom direction, the left-right direction, and the front-rear direction, which are just examples.

Although there are no particular limitations on the use of the surge voltage reduction member according to the invention, the surge voltage reduction member 1 according to the first embodiment is configured so as to lower a surge voltage by removing noise that is superimposed on a current flowing through a coil wire 3 (described later) that is connected to a battery (not shown) installed in an electric vehicle or a hybrid vehicle.

The surge voltage reduction member 1 shown in FIG. 1 is equipped with a magnetic body 2, insulating members 4 (see FIG. 4A), and a protective member 5 (see FIG. 4A). The individual constituent members of the surge voltage reduction member 1 will be described below.

First, the magnetic body 2 will be described. As shown in FIG. 1, the magnetic body 2 which is made of a magnetic material has a tubular shape. As shown in FIG. 1, the magnetic body 2 is formed so as to have an elliptical cross section when cut by a plane that is perpendicular to its axial direction and to have longer portions 6 and shorter portions 7.

Although in this embodiment the magnetic body 2 has an elliptical sectional shape, the invention is not limited to this case. For example, although not shown in any drawings, the magnetic body 2 may have a rectangular cross section and have longer portions and shorter portions.

As shown in FIG. 1, the magnetic body 2 has a through-hole 8 extending in its axial direction. The through-hole 8 is defined by the inner circumferential surface 9 of the magnetic body 2. The through-hole 8 is formed so as to have an elliptical cross section when the magnetic body 2 is cut by a plane that is perpendicular to its axial direction. The through-hole 8 is formed so that a coil wire 3 (i.e., bent coil element wires 10 and a straight coil element wire 11 (described later)) can be inserted through it. The through-hole 8 is formed so that its width in the shorter-axis direction of the magnetic body 2 (the top-bottom direction in FIG. 1) is approximately equal to the thickness of each of the bent coil element wires 10 and the straight coil element wire 11.

Next, the coil wire 3 will be described. The coil wire 3 which is shown in FIGS. 1 and 2 is inserted through the through-hole 8 of the magnetic body 2 and has a winding portion 12 which extends around one longer portion 6 of the magnetic body 2.

Although in the embodiment one coil wire 3 is provided, the invention is not limited this case; two or more coil wires 3 may be provided (refer to the second embodiment (described later)).

As shown in FIGS. 1 and 2, the coil wire 3 is formed by connecting the bent coil element wires 10 and the straight coil element wire 11. When the number of times a bent coil element wire 10 or a straight coil element wire 11 is inserted through the through-hole 8 is represented by N, the coil wire 3 is composed of (N−1) bent coil element wires 10 and one straight coil element wire 11. In the embodiment, N is equal to 3 and hence two bent coil element wires 10 and one straight coil element wire 11 are used.

The number N is variable, that is, the number of times a bent coil element wire 10 or a straight coil element wire 11 is inserted through the through-hole 8 and the number of bent coil element wires 10 are not limited to the numbers in the embodiment. For example, a configuration is possible in which N is equal to 2 and one bent coil element wire 10 and one straight coil element wire 11 are provided (refer to the second embodiment (described later)). Furthermore, N may be equal to 4 or larger in which case three or more bent coil element wires 10 and one straight coil element wire 11 are provided.

As shown in FIGS. 1 and 2, each of the bent coil element wires 10 and the straight coil element wire 11 is equipped with a conductor 13 and an insulating covering 14 which covers the conductor 13. The insulating covering 14 is removed by some working in end portions of each of the bent coil element wires 10 and the straight coil element wire 11 over a prescribed length, and the conductor 13 is exposed there.

The bent coil element wires 10 and the straight coil element wire 11 are formed from a flat-plate-shaped member so as to have a rectangular cross section taken perpendicularly to the axial direction, and have approximately the same thickness which is approximately equal to the width of the through-hole 8 in the shorter-axis direction of the magnetic body 2.

As shown in FIGS. 1 and 2, each bent coil element wire 10 has a through-hole passing portion 15, an intermediate portion 16, and an outside passing portion 17. Each bent coil element wire 10 is bent at the intermediate portion 16 and thereby approximately U-shaped when viewed from the side.

As shown in FIG. 1, the through-hole passing portion 15 is a portion that is located on the side of one end of each bent coil element wire 10 and is to be inserted through and pass through the through-hole 8 of the magnetic body 2.

As shown in FIG. 1, the intermediate portion 16 is located approximately at the center of each bent coil element wire 10 and is formed so as to connect the through-hole passing portion 15 and the outside passing portion 17. The intermediate portion 16 is a portion where the bent coil element wire 10 is bent so as to be approximately U-shaped when viewed from the side.

As shown in FIG. 1, the outside passing portion 17 is a portion that is located on the side of the other end of each bent coil element wire 10 and is to pass the magnetic body 2 outside when the through-hole passing portion 15 is inserted through the through-hole 8 of the magnetic body 2.

As shown in FIGS. 1 and 2, the straight coil element wire 11 is formed so as to extend straightly. A portion, located on the side of its one end, of the straight coil element wire 11 is to be inserted through the through-hole 8 of the magnetic body 2.

The winding portion 12 of the coil wire 3 will now be described. As shown in FIGS. 2 and 4A, in the case where two or more bent coil element wires 10 are provided as in the embodiment, the winding portion 12 is formed by connecting the through-hole passing portion 15 of one of adjoining bent coil element wires 10 to the outside passing portion 17 of the other of the adjoining bent coil element wires 10 and the outside passing portion 17 of the one of the adjoining bent coil element wires 10 to the straight coil element wire 11 when the through-hole passing portions 15 of the bent coil element wires 10 and the straight coil element wire 11 are inserted through the through-hole 8.

The through-hole passing portion 15 of the one of adjoining bent coil element wires 10 and the outside passing portion 17 of the other of the adjoining bent coil element wires 10 are connected to each other by welding the conductors 13 of the adjoining bent coil element wires 10. The outside passing portion 17 of the one of the adjoining bent coil element wires 10 and the straight coil element wire 11 are connected to each other by welding their conductors 13. The welding is resistance welding or ultrasonic welding, for example.

Although in the embodiment the conductors 13 are connected to each other by welding, the invention is not limited to this case; the conductors 13 may be connected to (i.e., integrated with) each other by thermocompression bonding. Although not shown in any drawings, in the thermocompression bonding, the conductors 13 are electrically connected to each other by applying heat and pressure to each conductor 13 using a thermocompression bonding machine or the like.

Next, the insulating members 4 will be described. Although not shown in detail in any figures, in the case where two or more bent coil element wires 10 are provided as in the embodiment, the insulating members 4 are provided in a portion where the through-hole passing portion 15 of one of adjoining bent coil element wires 10 and the outside passing portion 17 of the other of the adjoining bent coil element wires 10 are connected to each other and a portion where the outside passing portion 17 of the one of the adjoining bent coil element wires 10 and the straight coil element wire 11 are connected to each other, respectively.

An example of each insulating member 4 is an insulating cap that can be attached to each of the above connection portions. Another example of each insulating member 4 is a resin mold, which is, for example, formed by setting each connection portion in a case and performing potting molding.

Next, the protective member 5 will be described. Although not shown in detail in any figures, the protective member 5 is a holder that is formed so as to be able to cover the entire magnetic body 2 to increase the impact resistance of a surge voltage reduction member product.

Next, a manufacturing process (manufacturing work) for manufacturing the surge voltage reduction member 1 will be described by referring the its configuration described above.

In a first step, work of inserting bent coil element wires 10 and a straight coil element wire 11 through the through-hole 8 of a magnetic body 2 is performed. In the embodiment, as shown in FIG. 1, two bent coil element wires 10 and one straight coil element wire 11 are arranged in the left-right direction and the through-hole passing portions 15 of the two bent coil element wires 10 and the straight coil element wire 11 are inserted through the through-hole 8 of the magnetic body 2 in the direction indicated by arrow A from the rear side of the magnetic body 2.

In a second step, work of forming a winding portion 12 of a coil wire 3 is performed. In the embodiment, referring to FIGS. 3A and 3B, the conductors 13 of the through-hole passing portion 15 of one of the adjoining bent coil element wires 10 and the outside passing portion 17 of the other of the adjoining bent coil element wires 10 are connected to each other by welding. And the conductors 13 of the outside passing portion 17 of the one of the adjoining bent coil element wires 10 and the straight coil element wire 11 are connected to each other by welding. As a result, as shown in FIG. 4, a winding portion 12 is formed so as to extend around one of the longer portions 6 of the magnetic body 2.

In a third step, work of providing the connection portions with respective insulating members 4 is performed. In the embodiment, although not shown in detail in any figures, the insulating members 4 are provided for the portion where the through-hole passing portion 15 of the one of the adjoining bent coil element wires 10 and the outside passing portion 17 of the other of the adjoining bent coil element wires 10 are connected to each other and the portion where the outside passing portion 17 of the one of the adjoining bent coil element wires 10 and the straight coil element wire 11 are connected to each other, respectively.

In a fourth step, work of covering the magnetic body 2 with a protective member 5 is performed. The entire magnetic body 2 is covered with the protective member 5. Thus, the manufacturing process (manufacturing work) for manufacturing the surge voltage reduction member 1 is completed.

Next, advantages of the first embodiment will be described. As described above with reference to FIG. 1 to FIGS. 4A and 4B, according to the first embodiment, unlike in the conventional technique, work of winding the coil wire 3 on the magnetic body 2 is not necessary.

In the winding method as employed in the conventional technique, the working efficiency lowers as the number of turns (i.e., the number of times each coil wire passes through the through-hole of the magnetic body). In contrast, according to the first embodiment, since the winding portion 12 is formed by merely connecting the element wires 10 and 11 which constitute the coil wire 3, increase in the number of turns does not affect the working efficiency of manufacture of a surge voltage reduction member product.

According to the first embodiment, the ratio of occupation of the coil wire 3 inside the inner circumferential surface of the magnetic body 2 can be increased, whereby the height of a surge voltage reduction member product can be lowered. As such, the first embodiment provides advantages that the efficiency of manufacturing work can be made high and a surge voltage reduction member product can be made low in height while a surge voltage is lowered efficiently.

The first embodiment provides another advantage that since the connection portions of the element wires 10 and 11 of the coil wire 3 are provided with the respective insulating members 4, insulation can be attained reliably in the connection portions.

The first embodiment provides a further advantage that since the magnetic body 2 is covered with the protective member 5, the impact resistance of a surge voltage reduction member product can be increased.

Embodiment 2

The surge voltage reduction member according to the invention can be implemented in the form of not only the first embodiment but also a second embodiment. A surge voltage reduction member according to the second embodiment will be described with reference to FIGS. 5A and 5B to FIGS. 7A and 7B.

Figure 5A:
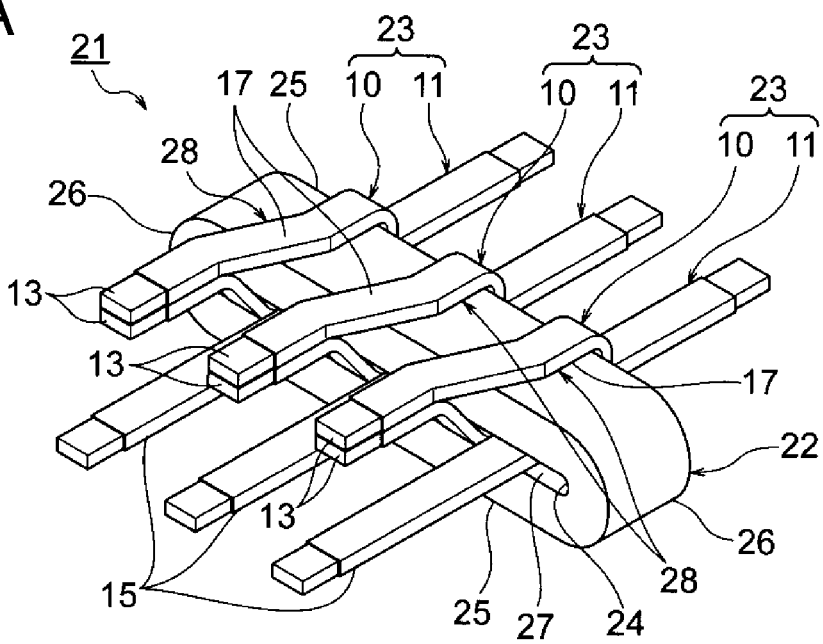
FIGS. 5A and 5B are a perspective view and a plan view of a surge voltage reduction member according to a second embodiment of the invention, respectively.
Figure 5B:
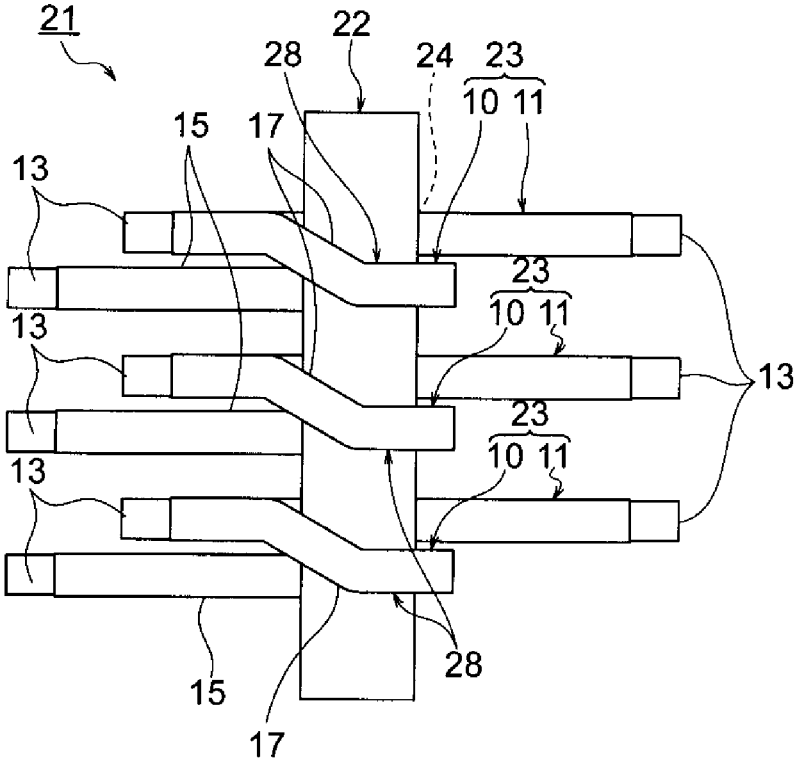
Figure 6A:
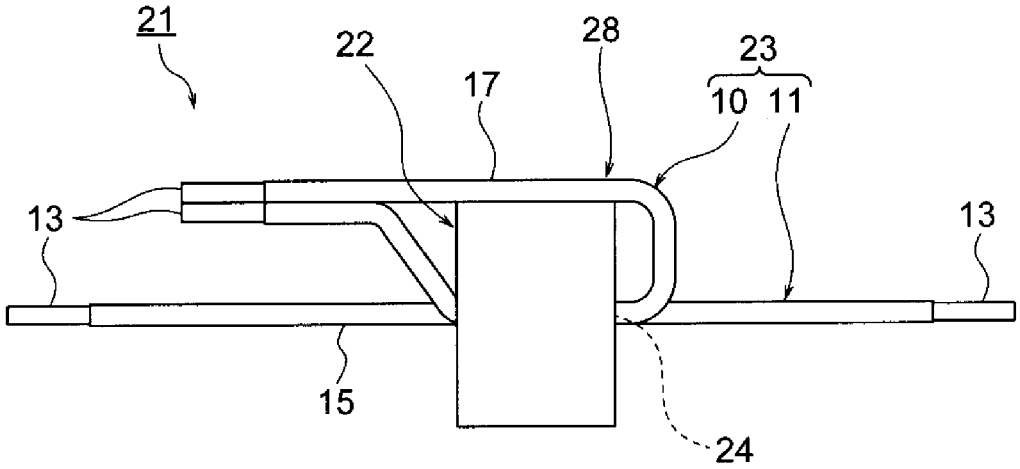
FIGS. 6A and 6B are a side view and a front view of the surge voltage reduction member according to the second embodiment, respectively.
Figure 6B:
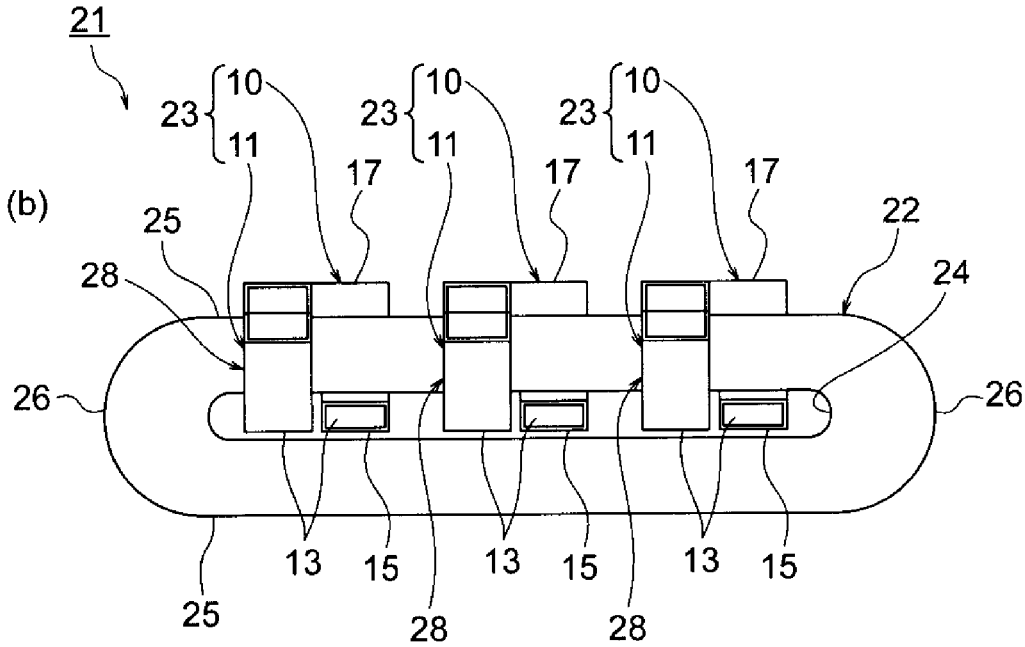
Figure 7A:
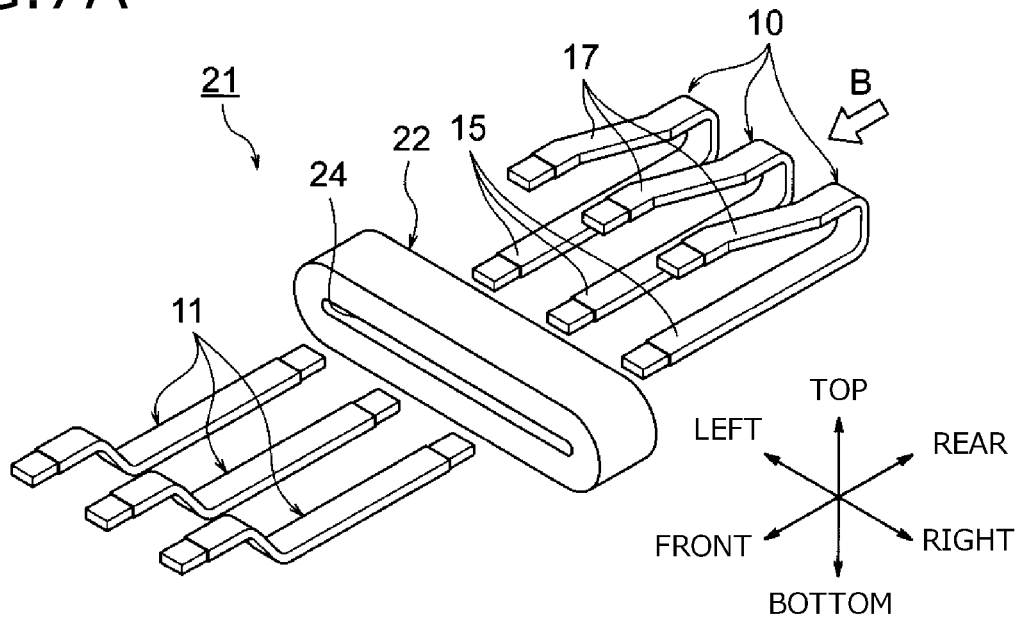
FIGS. 7A and 7B illustrate a manufacturing process of the surge voltage reduction member according to the second embodiment.
Figure 7B:
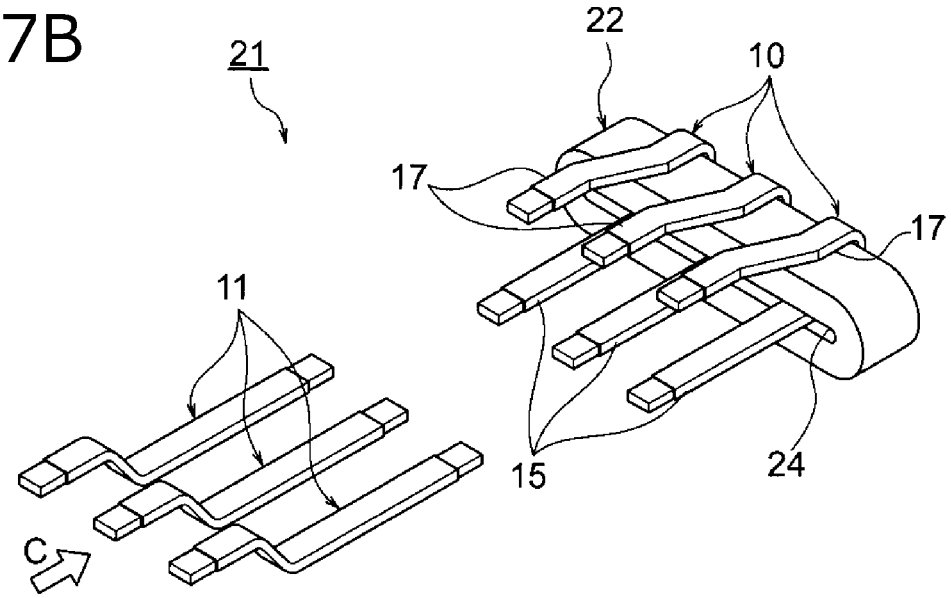

FIGS. 5A and 5B are a perspective view and a plan view of the surge voltage reduction member according to the second embodiment of the invention, respectively. FIGS. 6A and 6B are a side view and a front view of the surge voltage reduction member according to the second embodiment, respectively. FIGS. 7A and 7B illustrate a manufacturing process of the surge voltage reduction member according to the second embodiment; FIG. 7A is a perspective view showing a state before insertion of bent coil element wires and straight coil element wires through a through-hole of a magnetic body and FIG. 7B is a perspective view showing a state after insertion of the bent coil element wires through the through-hole of the magnetic body.

The arrows shown in FIG. 7A indicate the top-bottom direction, the left-right direction, and the front-rear direction, which are just examples. Constituent elements having the same ones in the first embodiment will be given the same reference numerals as the latter, and detailed descriptions therefor will be omitted.

As shown in FIGS. 5A and 5B and FIGS. 6A and 6B, the surge voltage reduction member 21 according to the second embodiment is equipped with a magnetic body 22, coil wires 23, insulating members (not shown), and a protective member (not shown).

In this embodiment, three coil wires 23 are provided. One of the coil wires 23 will be described below. As shown in FIGS. 5A and 5B and FIGS. 6A and 6B, the coil wire 23 has a winding portion 28 which extends around one of longer portions 26 of the magnetic body 22. In the embodiment, in the coil wire 23, the number N of times a bent coil element wire 10 or a straight coil element wire 11 is inserted through a through-hole 24 of the magnetic body 22 is equal to 2 and one bent coil element wire 10 and one straight coil element wire 11 are provided.

The winding portion 28 is formed by inserting a through-hole passing portion 15 of the bent coil element wire 10 and the straight coil element wire 11 through the through-hole 24 of the magnetic body 22 and connecting an outside passing portion 17 of the bent coil element wire 10 and the straight coil element wire 11.

Next, a manufacturing process (manufacturing work) for manufacturing the surge voltage reduction member 21 will be described by referring the its configuration described above.

In a first step, work of inserting bent coil element wires 10 through the through-hole 24 of a magnetic body 22 is performed. In the embodiment, as shown in FIG. 7A, three bent coil element wires 10 are arranged in the left-right direction and the through-hole passing portions 15 of the three respective bent coil element wires 10 are inserted through the through-hole 24 of the magnetic body 22 in the direction indicated by arrow B from the rear side of the magnetic body 22.

In a second step, work of inserting straight coil element wires 11 through the through-hole 24 of a magnetic body 22 is performed. In the embodiment, as shown in FIG. 7B, three straight coil element wire 11 are arranged in the left-right direction and are inserted through the through-hole 24 of the magnetic body 22 in the direction indicated by arrow C from the front side of the magnetic body 22.

In a third step, work of forming winding portions 28 of respective coil wires 23 is performed. In the embodiment, the conductors 13 of the through-hole passing portion 15 of each bent coil element wire 10 and the associated straight coil element wire 11 are connected to each other by welding. As a result, as shown in FIGS. 5A and 5B and FIGS. 6A and 6B, a winding portion 28 is formed so as to extend around one of the longer portions 25.

In a fourth step, work of providing the connection portions with respective insulating member is performed. In the embodiment, although not shown in detail in any figures, an insulating member is provided for each portion where the through-hole passing portion 15 of a bent coil element wire 10 and the associated straight coil element wire 11 are connected to each other.

In a fifth step, work of covering the magnetic body 22 with a protective member is performed. Although not shown in detail in any figures, the entire magnetic body 22 is covered with the protective member. Thus, the manufacturing process (manufacturing work) for manufacturing the surge voltage reduction member 21 is completed.

Next, advantages of the second embodiment will be described. As described above with reference to FIGS. 5A and 5B to FIGS. 7A and 7B, the second embodiment provides the same advantages as the first embodiment.

Although the two embodiments have been described above, it goes without saying that various modifications are possible without departing from the spirit and scope of the invention.

What is claimed is:

1. A surge voltage reduction member comprising:

a tubular magnetic body having longer portions and shorter portions and a through-hole that is defined by an inner circumferential surface of the magnetic body; and at least one coil wire which is inserted through the through-hole and has a winding portion which is winded around a portion of the magnetic body, wherein the coil wire is formed by connecting a bent coil element wire which is bent so as to have a U shape and a straight coil element wire which has an approximately straight shape;

wherein the coil wire has (N−1) bent coil element wires and one straight coil element wire where N is the number of times in which the bent coil element wire and the straight coil element wire are inserted through the through-hole;

wherein each of the bent coil element wire and the straight coil element wire is formed from a flat-plate-shaped member having a rectangular cross section taken perpendicularly to its axial direction and the bent coil element wire and the straight coil element wire are approximately identical in thickness;

wherein the width of the through-hole in the shorter-axis direction of the magnetic body is approximately equal to the thickness of the bent coil element wire or wires and the straight coil element wire;

wherein the bent coil element wire has a through-hole passing portion that is inserted through the through-hole and an outside passing portion that passes the magnetic body outside when the through-hole passing portion is inserted through the through-hole;

wherein where the coil wire has only one bent coil element wire, the winding portion is formed by connecting the outside passing portion of the bent coil element wire and the straight coil element wire after the through-hole passing portion of the bent coil element wire and the straight coil element wire are inserted through the through-hole; and wherein where the coil wire has two or more bent coil element wires, the winding portion is formed by connecting the through-hole passing portion of one of adjacent bent coil element wires to the outside passing portion of the other of the adjacent bent coil element wires and connecting the outside passing portion of the one of the adjacent bent coil element wires to the straight coil element wire after the through-hole passing portions of the bent coil element wires and the straight coil element wire are inserted through the through-hole.

2. The surge voltage reduction member according to claim 1, wherein where the coil wire has only one bent coil element wire, a portion where the outside passing portion of the bent coil element wire and the straight coil element wire are connected to each other is provided with an insulating member; and wherein where the coil wire has two or more bent coil element wires, a portion where the through-hole passing portion of the one of the adjacent bent coil element wires and the outside passing portion of the other of the adjacent bent coil element wires are connected to each other and a portion where the outside passing portion of the one of the adjacent bent coil element wires and the straight coil element wire are connected to each other are provided with insulating members respectively.

3. The surge voltage reduction member according to claim 1, further comprising:

a protective member which covers the magnetic body.

* * * * *